US009251971B2

(12) United States Patent
Albrecht et al.

(10) Patent No.: US 9,251,971 B2
(45) Date of Patent: Feb. 2, 2016

(54) ON-LOAD TAP CHANGER

(75) Inventors: Wolfgang Albrecht, Wenzenbach (DE); Klaus Hoepfl, Maxhuette-Haihof (DE); Silke Wrede, Zeitlarn (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 238 days.

(21) Appl. No.: 14/001,064

(22) PCT Filed: Feb. 6, 2012

(86) PCT No.: PCT/EP2012/051963

§ 371 (c)(1),
(2), (4) Date: Aug. 27, 2013

(87) PCT Pub. No.: WO2012/123187

PCT Pub. Date: Sep. 20, 2012

(65) Prior Publication Data

US 2013/0341166 A1 Dec. 26, 2013

(30) Foreign Application Priority Data

Mar. 12, 2011 (DE) ..... 10 2011 013 749

(51) Int. Cl.

| | |
|---|---|
| ***H01H 19/00*** | (2006.01) |
| ***H01H 21/00*** | (2006.01) |
| ***H01H 9/00*** | (2006.01) |
| ***H01H 3/44*** | (2006.01) |

(52) U.S. Cl.

CPC ..... *H01H 9/0027* (2013.01); *H01H 3/44* (2013.01)

(58) Field of Classification Search

CPC ..... H01H 3/02; H01H 25/002; H01H 9/0027; H01H 3/44; B60N 2/0228; H01F 29/02; H01F 30/12

USPC ..... 200/11 TC

See application file for complete search history.

(56) References Cited

U.S. PATENT DOCUMENTS

| | | | | |
|---|---|---|---|---|
| 3,572,143 | A | 3/1971 | VanRiemsdijk | |
| 3,798,395 | A * | 3/1974 | Norman et al. | 200/17 R |
| 7,942,073 | B2 | 5/2011 | Jonsson | |
| 7,982,142 | B2 | 7/2011 | Jonsson | |
| 8,119,939 | B2 | 2/2012 | Albrecht | |
| 2012/0103766 | A1 * | 5/2012 | Hoepfl et al. | 200/11 J |

FOREIGN PATENT DOCUMENTS

| | | |
|---|---|---|
| DE | 1956369 A | 5/1971 |
| DE | 2339973 A | 8/1973 |
| GB | 798740 B | 7/1958 |
| GB | 2014794 A | 8/1979 |

* cited by examiner

*Primary Examiner* — Briggitte R Hammond
*Assistant Examiner* — Lheiren Mae A Caroc
(74) *Attorney, Agent, or Firm* — Andrew Wilford

(57) ABSTRACT

An on-load tap changer for uninterrupted changeover between winding taps of a tapped transformer has a separate selector for power-free preselection of the winding tap to be switched to, a separate load changeover switch for the actual load changeover from the previous to the preselected new winding tap, a rotatable drive shaft, and a force accumulator with at least one force-accumulator spring that for each load changeover is initially stressed by the drive shaft and after triggering thereof abruptly actuates the load changeover switch. A gear operatively connected with the drive shaft can load the force accumulator. A first mechanical freewheel between the gear and the force accumulator temporarily decouples the force accumulator from rotation with the drive shaft in such a manner that the force accumulator can be stressed with a delay in time after the start of actuation of the drive shaft.

3 Claims, 5 Drawing Sheets

ON-LOAD TAP CHANGER

CROSS REFERENCE TO RELATED APPLICATIONS

This application is the US-national stage of PCT application PCT/EP2012/051963 filed 6 Feb. 2012 and claiming the priority of German patent application 102011013749.1 itself filed 12 Mar. 2011.

FIELD OF THE INVENTION

The invention relates to an on-load tap changer with separate selector and load changeover switch for uninterrupted changeover between different winding taps of a tapped transformer under load. The tap changers of the above-described type have a separate selector for power-free preselection of the winding tap that is to be switched to, as well as a load changeover switch for the actual changeover from the previous to the preselected new winding tap. Since this changeover takes place abruptly, on-load tap changers of that kind have a force accumulator.

BACKGROUND OF THE INVENTION

Such a force accumulator for a load changeover switch is already known from DE-PS 19 56 369 as well as DE-PS 28 06 282 [GB 2,014,794]. It is loaded, i.e. stressed, at the start of each actuation of the on-load tap changer by the drive shaft thereof. The known force accumulator substantially consists of a pull-up carriage and a jump carriage between which force accumulator springs as force accumulators are arranged. In these known force accumulators guide rods are provided on which pull-up carriages as well as jump carriages are mounted to be movable therealong independently of one another. At the same time, the guide rods form the guide for the force accumulator springs.

The pull-up carriage is moved linearly relatively toward the jump carriage by an eccentric connected with the drive shaft; the force accumulator springs disposed therebetween are thereby stressed. When the pull-up carriage has reached its new end position, a locking, which until then is fixed, of the jump carriage is released. The jump carriage now abruptly follows—since it stands under the force of the force accumulator springs—the afore-mentioned linear movement of the pull-up carriage, similarly linearly. This abrupt movement of the jump carriage is converted into a rotational movement of a drive output shaft that in turn actuates the load changeover switch. An alternating to-and-fro switching between two positions is thus realized in this force accumulator.

A further force accumulator, there termed spring jump drive, is known from WO 19 9/008924 whose storage spring is stressable by a drive. In that case the driven element is connected with a special coupling element that can be triggered in only one direction regardless of the direction of rotation of the drive.

WO 2006/004527 [U.S. Pat. No. 7,982,142] relates to a further arrangement of that kind, in which the permanent main contacts of an on-load tap changer are actuated always in the same rotational direction, regardless of the drive direction of the drive shaft, by a special mechanical transmission.

A quite similar arrangement is known from WO 2007/067144 [U.S. Pat. No. 7,942,073]. A device for transmission of a rotational movement in a load changeover switch is described therein, wherein the rotational movement of a drive shaft, which is rotatable in both directions, is converted into a rotational movement of a drive output shaft always rotating in the same direction.

The force accumulators, which are known from the prior art, for an on-load tap changer of the above-described kind thus allow either to-and-fro switching in the case of switching processes taking place in succession or onward switching always in the same direction.

OBJECT OF THE INVENTION

The object of the invention is to provide a tap changer of the above-described kind with a force accumulator that enables multiple switching in one direction or alternatively also to-and-fro switching, independently of the direction of rotation of the drive output shaft. The force accumulator according to the invention shall be of simple construction able to dispense with complicated mechanical means for movement reversal and able to be actuated directly by any direction of rotation of the drive shaft even in the case of several switching processes taking place in succession.

A force accumulator is indeed already known from WO2007/095978 [U.S. Pat. No. 8,119,939] that can be stressed by a drive shaft rotating in desired directions, and follows this rotational movement after triggering. However, this known force accumulator is suitable merely for an on-load tap changer of the load selector type in which preselection of the winding tap and actual load changeover are constructionally combined. It is not suitable for an on-load tap changer of the above-described kind with separate selector and load changeover switch. This is particularly because in the case of the known force accumulator a fixed trigger angle results that corresponds with the spacing between adjacent—respectively connectable—load selector contacts in the oil vessel.

SUMMARY OF THE INVENTION

The object of the invention is fulfilled by an on-load tap changer with a force accumulator and in which the drive shaft can be actuated in any rotational direction regardless of whether switching in the direction of 'higher' or 'lower' is to take place, wherein at the same time the force accumulator can be similarly drawn up in any direction and can be triggered later. In other words: the force accumulator in the case of the invention is appropriate equally in the case of a drive shaft repeatedly rotating in the same direction and a drive shaft rotating in alternating directions, without complicated mechanical means—as in the prior art—being needed for rotational direction reversal or rotational direction standardization.

BRIEF DESCRIPTION OF THE DRAWING

The invention is explained in more detail in the following with reference to drawings in which.

SPECIFIC DESCRIPTION OF THE INVENTION

Figure 1:
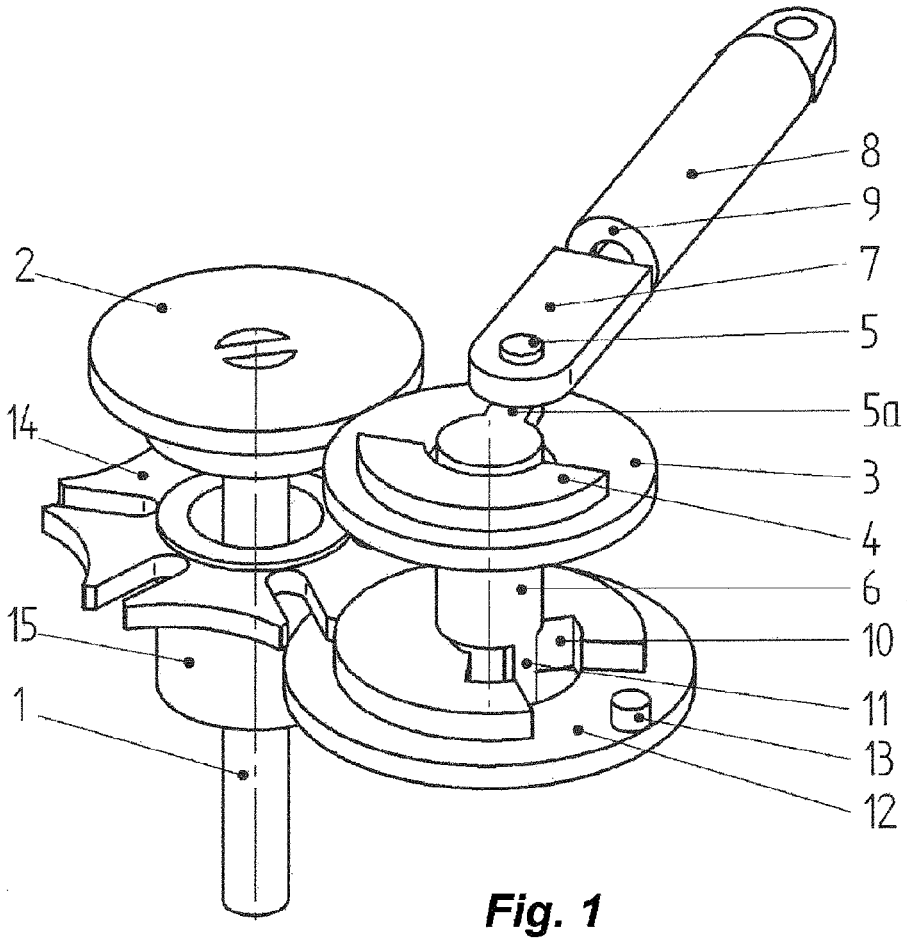
FIG. 1 shows an on-load tap changer according to the invention, more precisely the drive thereof without load changeover switch contacts and selector, in schematic illustration in rest position.

The drive of an on-load tap changer according to the invention is schematically shown in FIG. 1. It comprises a drive shaft that is actuated by a drive (not illustrated here). Disposed on the drive shaft 1 is a gear 2 that co-operates with a further gear 3, the mounting of which is not illustrated. An abutment 4 is located on the gear 3. This abutment 4 co-operates with a further abutment 5*a* arranged on an intermediate shaft 6 that is disposed centrally within the gear 3 and rotatable independently thereof. Arranged at the abutment 5*a* is a pin 5 that in turn is connected with an actuating rod 7 of a force accumulator 8; a force accumulator spring 9 can be drawn up by it. A further abutment 10 is provided in the lower region of the intermediate shaft 6 and co-operates with a counter-abutment 11 on a drive output wheel 12. The drive output wheel 12 is again rotatable independently of the previously mentioned components. It comprises a roller 13 that co-operates with a Geneva wheel 14, i.e. can engage therein. The Geneva wheel 14 is in turn connected with a load changeover switch drive 15 that is only schematically shown and which for its part actuates the load changeover switch not shown here. The illustrated Geneva gear is only one possible form of construction of a possible step transmission within the scope of the invention.

The on-load tap changer according to the invention thus has two separate freewheels: a first freewheel, consisting of abutment 4 and co-operating abutment 5*a*, and a second freewheel, consisting of abutment 10 and counter-abutment 11.

FIG. 1 shows this on-load tap changer at the start of actuation. The drive shaft 1 begins to rotate, thus also the gear 2 and the gear 3. Since the abutment 4 still runs freely on the gear 3, the other components still remain in the rest position.

Figure 2:
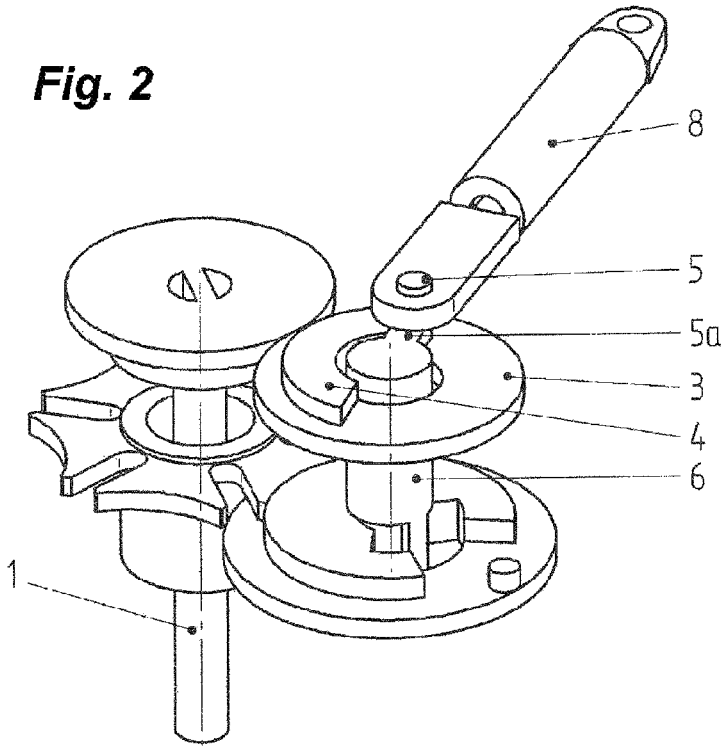
FIG. 2 shows this on-load tap changer after start of actuation.

FIG. 2 shows this on-load tap changer with continued rotation of the drive shaft 1, the abutment 4 now impinges on the abutment 5*a* of the intermediate shaft 6, rotates this and at the same time draws up the force accumulator 8, more precisely the force accumulator spring 9 thereof.

Figure 3:
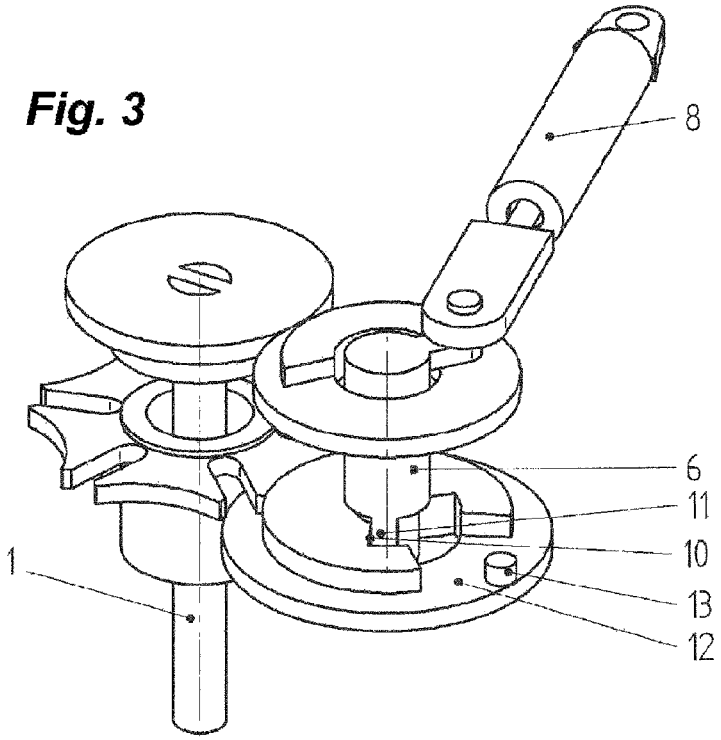
FIG. 3 shows this on-load tap changer in the case of continued actuation, i.e. pull-up of the force accumulator.

FIG. 3 shows the on-load tap changer according to the invention in the case of further drawing-up of the force accumulator 8. The abutment 10 now impinges on the counter-abutment 11 and the drive output wheel 12 begins to rotate.

Figure 4:
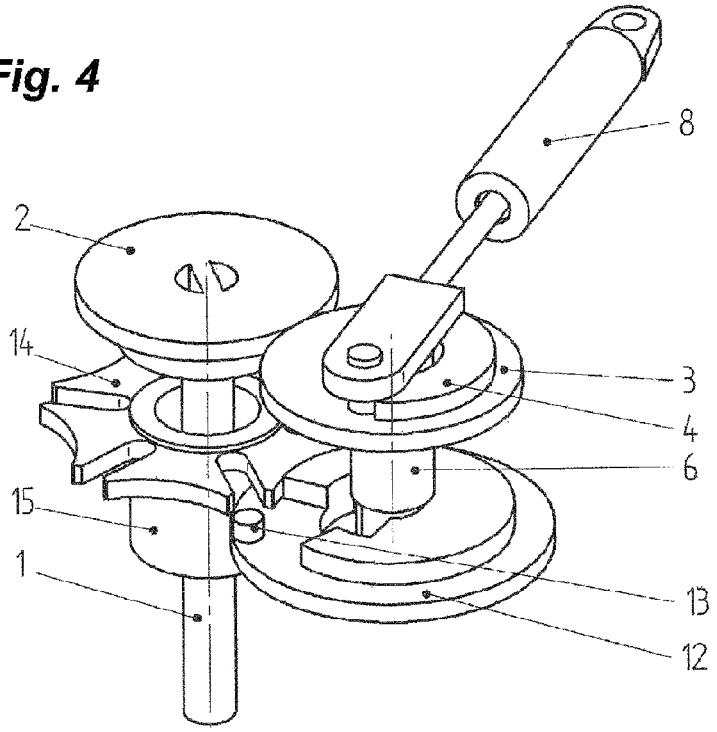
FIG. 4 shows this on-load tap changer in the case of a fully stressed force accumulator at the instant of triggering thereof.

FIG. 4 shows the position in the case of complete drawing-up of the force accumulator 8. The pin 5 and thus the actuating rod 7 of the force accumulator 8 have reached the dead-center point on the gear 3 and in the case of continued rotation the force accumulator spring 9 is abruptly relaxed. In this position the abutment 10 at the lower part of the intermediate shaft 6 impinges, without change, on the counter-abutment 11 of the drive output wheel 12 that is stationary until now and further entrains this. The roller 13 in that case still runs freely.

Figure 5:
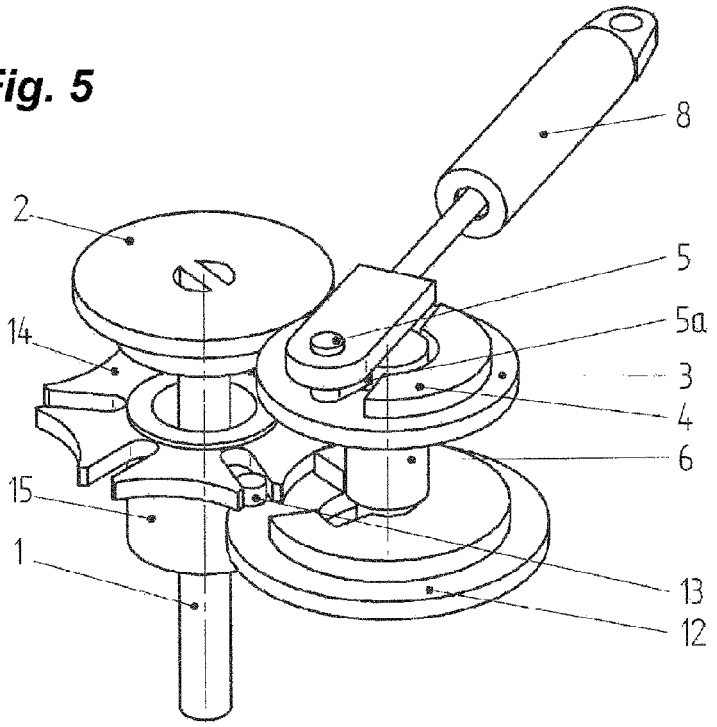
FIG. 5 shows this on-load tap changer after triggering of the force accumulator and thus actuation of the load changeover switch contacts (not illustrated)

FIG. 5 shows how as a consequence of the deflected force accumulator 8 the drive output wheel 12 rapidly rotates. Due to the rotation of the drive output wheel 12 the roller 13 engages in the Geneva wheel 14 and rotates this. The load changeover switch drive 15 is thus also rotated that in turn abruptly actuates the load changeover switch, i.e. the contacts thereof. At the same time, however, the drive shaft 1 still rotates through a defined angle. If for whatever reasons, for example through breakage of the force accumulator spring 9, the force accumulator 8 should not happen to trigger and thus the Geneva wheel 14 cannot be actuated by the triggered force accumulator as actually intended, the new end position of the load changeover switch is nevertheless necessarily reached. This is due to the fact that the drive shaft 1 that still continues to rotate, guides—by way of the gears 2 and 3, the intermediate shaft 6 and the drive output wheel 12—the roller 13 for its part into the Geneva wheel 14. However, by contrast to the usual rapid actuation due to the triggered force accumulator 8, this now happens slowly and continuously. In all cases it is ensured by the invention that the load changeover switch necessarily reliably reaches its new position even in the explained fault case and cannot remain in an undefined intermediate state.

Figure 6:
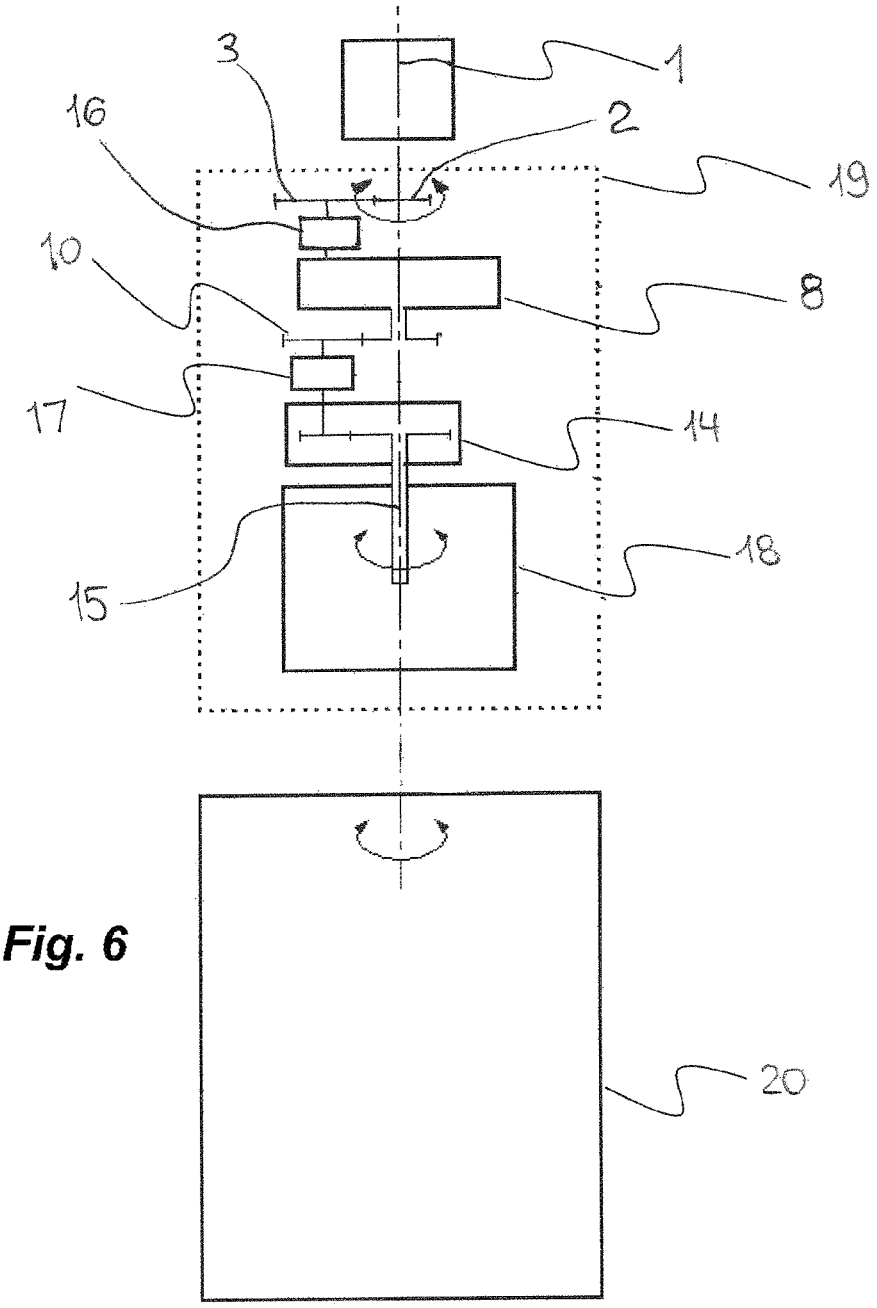
FIG. 6 shows an on-load tap changer according to the invention in schematic, complete illustration.

FIG. 6 shows the schematic overall construction of an on-load tap changer according to the invention. The illustration shows that a first freewheel 16 is provided between the gear 3 and force accumulator 8. This freewheel 16 consists of the abutment 4 shown in FIGS. 1 to 5 and the co-operating abutment 5*a*. In addition, the illustration shows that the force accumulator 8 acts on a further freewheel 17 that consists of the abutment 10 shown in FIGS. 1 to 5 and the co-operating counter-abutment 11. A delayed engagement in the Geneva wheel 14, and in fact through the roller 13 shown in FIGS. 1 to 5, takes place by way of this freewheel 17. The load changeover switch drive 15 for actuation of the load changeover switch thus rotates in the same direction as the drive shaft 1. Also shown is a load changeover switch housing 19 that encloses the load changeover switch, and thereunder a selector 20 that is continuously actuated by the drive shaft 1 for load-free preselection of the new winding tap that is to be subsequently switched to.

Figure 7:
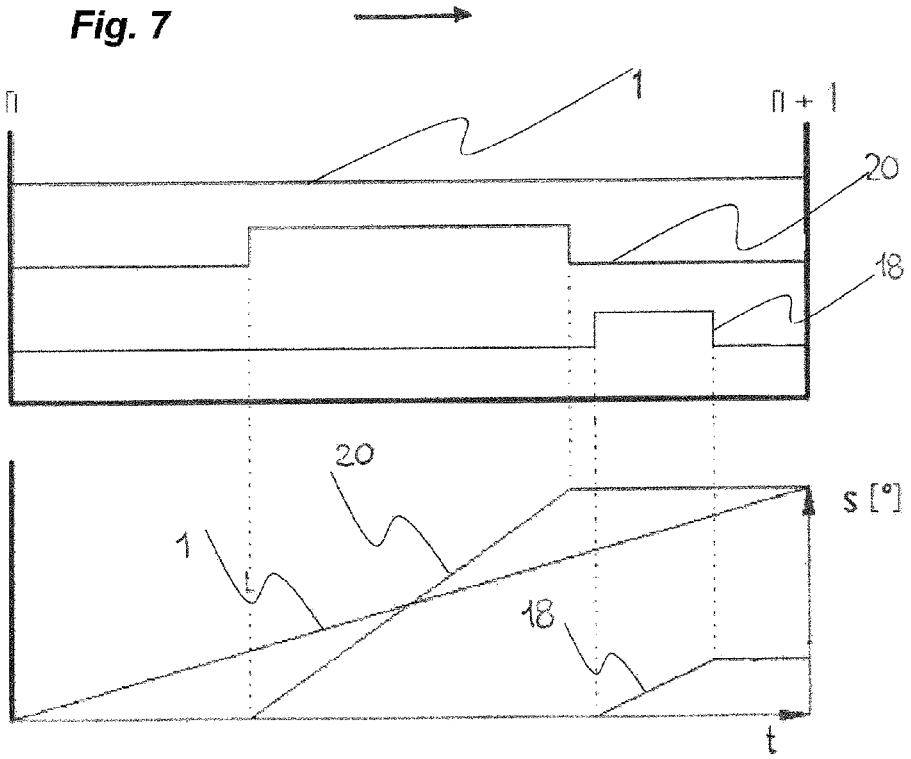
FIG. 7 shows the actuation sequence of an on-load tap changer according to the invention as well as the associated travel/time diagram in the case of a complete changeover from n to n+1.

FIG. 7 shows a switching sequence of an on-load tap changer according to the invention. The sequence in the case of changeover from a winding tap n to an adjacent new winding tap n+1 is shown in the upper part. It can be seen that at the start of a changeover process the drive shaft 1 rotates continuously and after a specific rotational angle begins to move the selector 20 from the previous to the new winding tap. After this process has been concluded and the selector 20 has reached its new position, the load changeover switch 18 is abruptly actuated, this taking place through the triggered force accumulator. Finally, as already explained further above, the drive shaft 1 continues to move by a specific amount before the changeover process is completely concluded. In the case of a further changeover in the same direction what is illustrated is repeated. The corresponding course of rotational angle is shown in the lower part of FIG. 7. It can be seen that the drive shaft that continuously rotates, initially actuates the selector 20. Only after this has reached its position is the load changeover switch 18 triggered.

Figure 8:
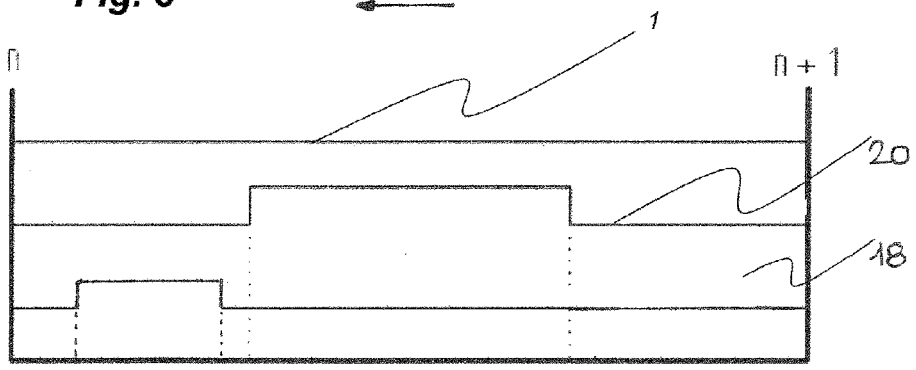
FIG. 8 shows the actuation sequence of an on-load tap changer according to the invention in the case of a subsequent load changeover from n+1 back to n in arrow direction.

FIG. 8 shows a switching sequence in opposite rotational direction of the drive shaft, i.e. from the tap n+1 back to the tap n. The corresponding directions of movement of the drive shaft 1 are shown in each of FIGS. 7 and 8 by an arrow.

Overall, the invention makes it possible in simple manner for the separate load changeover switch to be actuated not only several times in succession in the same rotational direction of the drive shaft, but also alternatively in the case of rotational direction reversal of the drive shaft, in simple manner.

The invention claimed is:

1. An on-load tap changer for uninterrupted changeover between winding taps of a tapped transformer, the tap changer comprising:

a separate selector for power-free preselection of the winding tap to be switched to;

a separate load changeover switch for the actual load changeover from the previous to the preselected new winding tap;

a rotatable drive shaft;

a force accumulator with at least one force-accumulator spring that for each load changeover is initially stressed by the drive shaft and after triggering thereof abruptly actuates the load changeover switch;

a gear operatively connected with the drive shaft and capable of loading the force accumulator;

a first mechanical freewheel between the gear and the force accumulator for temporarily decoupling the force accumulator from rotation with of the drive shaft in such a manner that the force accumulator can be stressed with a delay in time after the start of actuation of the drive shaft;

a second mechanical freewheel acted on by the force-accumulator spring for temporarily decoupling the load changeover switch from the rotational movement of the drive shaft;

a step transmission engaged by the second mechanical freewheel for actuation of the load changeover switch such that the load changeover switch is actuatable with a delay in time after the conclusion of actuation of the selector, the two freewheels being so arranged and designed that during a changeover process the drive shaft is continuously actuatable, the selector being initially actuatable by the drive shaft for load-free preselection of the winding tap to be switched over to, the load changeover switch being actuatable by the drive shaft after the conclusion of the selection process by the selector, the drive shaft continuing to run through a defined rotational angle after the conclusion of the changeover process by means of the load changeover switch;

an intermediate shaft rotatable independently of the drive shaft and having a first abutment;

a second abutment on the gear coacting with the first abutment so as to form the first mechanical freewheel, the force-accumulator spring acting on the intermediate shaft;

a third abutment on the intermediate shaft; and an independently rotatable drive output wheel carrying a fourth abutment that cooperates with the third abutment to form the second mechanical freewheel, the drive output wheel actuating the load changeover switch via the step transmission.

2. The on-load tap changer defined in claim 1, further comprising:

a Geneva wheel; and a roller on the drive output wheel that forms the step transmission with the Geneva wheel.

3. The on-load tap changer defined in claim 1, wherein the force-accumulator spring has one fixed end an opposite free end mechanically connected with the abutment of the intermediate shaft such that the force-accumulator spring can be loaded when the intermediate shaft rotates.

* * * * *